United States Patent [19]

Hoover

[11] Patent Number: 4,635,070

[45] Date of Patent: Jan. 6, 1987

[54] DUAL MODE ANTENNA HAVING SIMULTANEOUS OPERATING MODES

[75] Inventor: William G. Hoover, Los Altos Hills, Calif.

[73] Assignee: Granger Associates, Santa Clara, Calif.

[21] Appl. No.: 563,288

[22] Filed: Dec. 19, 1983

[51] Int. Cl.[4] ..... H01Q 1/36; H01Q 3/24

[52] U.S. Cl. ..... 343/852; 343/876; 343/895

[58] Field of Search ..... 343/792.5, 895, 886, 343/876, 852, 890, 891, 908

[56] References Cited

U.S. PATENT DOCUMENTS

| | | | |
|---|---|---|---|
| 3,392,395 | 7/1968 | Hannan | 343/853 |
| 3,396,398 | 8/1968 | Dunlavy | 343/844 |
| 3,470,559 | 9/1969 | Radford | 343/853 |
| 3,740,756 | 6/1973 | Sosin | 343/853 |
| 4,101,901 | 7/1978 | Kommrusch | 343/853 |
| 4,103,304 | 7/1978 | Burnham | 343/853 |

*Primary Examiner*—Eli Lieberman

*Attorney, Agent, or Firm*—Flehr, Hohbach, Test, Albritton & Herbert

[57] ABSTRACT

A dual mode broad band antenna especially designed to provide simultaneously high and low angle radiation patterns relative to a horizontal ground plane is disclosed herein. This particular antenna utilizes four wire radiators in the form of an inverted conical log-spiral supported in a vertically extending fashion a predetermined distance above the horizontal ground plane. In order to operate the antenna in its high and low angle modes simultaneously, first and second oppositely phased AC currents are applied to the radiators in two different ways through specifically connected hybrid isolating transformers.

17 Claims, 13 Drawing Figures

DUAL MODE ANTENNA HAVING SIMULTANEOUS OPERATING MODES

The present invention relates generally to antennas and more particularly to a specific improvement in the four wire dual mode spiral antenna described in U.S. patent application Ser. No. 454,693 filed Dec. 30, 1982, now U.S. Pat. No. 4,498,084 (hereinafter referred to as the "Werner et al application").

In the Werner et al patent application just recited, a broad band antenna taking the form of a four radiator inverted conical log-spiral is disclosed. More specifically, means are provided for supporting first, second, third and fourth wire radiators in electrically insulated relationship to one another around the surface of an imaginary inverted cone. The cone is supported vertically on a horizontal ground plane and has its apex located a fixed distance above that plane. Moreover, the four radiators defining the cone, starting with the first one, are supported so as to provide successively interlaced spiral windings beginning at the lowermost ends of the radiators adjacent the apex of the cone and ending at their uppermost ends adjacent the cone's inverted base. Both the lowermost ends and the uppermost ends of these radiators are circumferentially spaced 90° from one another about the cone's central axis. In addition to these components, the overall antenna includes a power feed arrangement which utilizes first and second alternating currents having the same amplitude and a given frequency but 180° out of phase with one another.

In accordance with one particular aspect of the Werner et al antenna, the feed arrangement just recited includes means for simultaneously electrically connecting the first alternating current to the lowermost ends of the first and second radiators (e.g., one pair of adjacent radiators) and the second alternating current to the lowermost ends of the third and fourth radiators (e.g., a second pair of adjacent radiators). In this way, the four individual radiators are functionally converted to a single pair for producing a high angle radiation pattern relative to the horizontal ground plane. At the same time, the overall feed arrangement includes a simple switch, for example, a vacuum-type of double pole double throw relay switch, for alternatively connecting one of the alternating currents to the lowermost ends of the first and third radiators (a first pair of opposite ones) while the other alternating current is connected to the lowermost ends of the second and fourth radiators (a second pair of opposite ones). This causes the antenna to operate as a four element spiral to produce a low angle radiation pattern relative to the same horizontal ground plane.

The Werner et al antenna is quite satisfactory for its intended purpose, that is, as a means for alternatively producing high and low angle radiation patterns. However, this antenna (as specifically described in the Werner et al patent application) cannot produce the same high and low angle radiation patterns simultaneously. This is best exemplified in FIGS. 1 and 2 which will be discussed in detail hereinafter.

In view of the foregoing, it is an object of the present invention to improve upon the antenna described in the Werner et al patent application by providing relatively uncomplicated and reliable means for allowing it to produce the disclosed high and low angle radiation patterns simulataneously.

Another object of the present invention is to provide an antenna generally which is capable of producing simultaneously a plurality of separate and distinct radiation patterns, each being produced as if the others were not present.

As will be described in more detail hereinafter, the antenna disclosed herein is one which comprises a plurality of radiators and means for supporting the radiators in electrically insulated relationship to one another relative to a fixed reference. The antenna also includes a radiator energizing arrangment which utilizes first means connected with the radiators in a first specific operating mode for energizing these radiators in order to produce a first specific radiation pattern relative to the fixed reference and second means connected with the radiators in a second, different specific operating mode for energizing the radiators in order to produce a second, different specific radiation pattern relative to the same fixed reference. In accordance with the present invention, the first radiator energizing means includes its own signal isolating means for preventing connection of the second radiator energizing means with the radiators in the second operating mode from affecting the energization of the radiators in said first operating mode. At the same time, the second radiator energizing means includes its own signal isolating means for preventing connection of the first radiator energizing means with the radiators in the first operating mode from affecting the energization of the radiators in said second operating mode. In this way, the radiators can be energized in both the operating modes simultaneously for producing both of the radiation patterns simultaneously.

With particular regard to the antenna described in the Werner et al patent application, the present invention preferably provides an arrangement of hybrid transformers connected in circuit with the antennas and two balanced current sources for simultaneously energizing the individual radiators making up the antenna with alternating current in the two different operating modes described in order to simultaneously produce the radiator patterns set forth and without fear of electrically shorting or otherwise damaging either current source as a result of this dual operating capability.

The present invention will be described in more detail hereinafter in conjunction with the drawings wherein.

Figure 1:
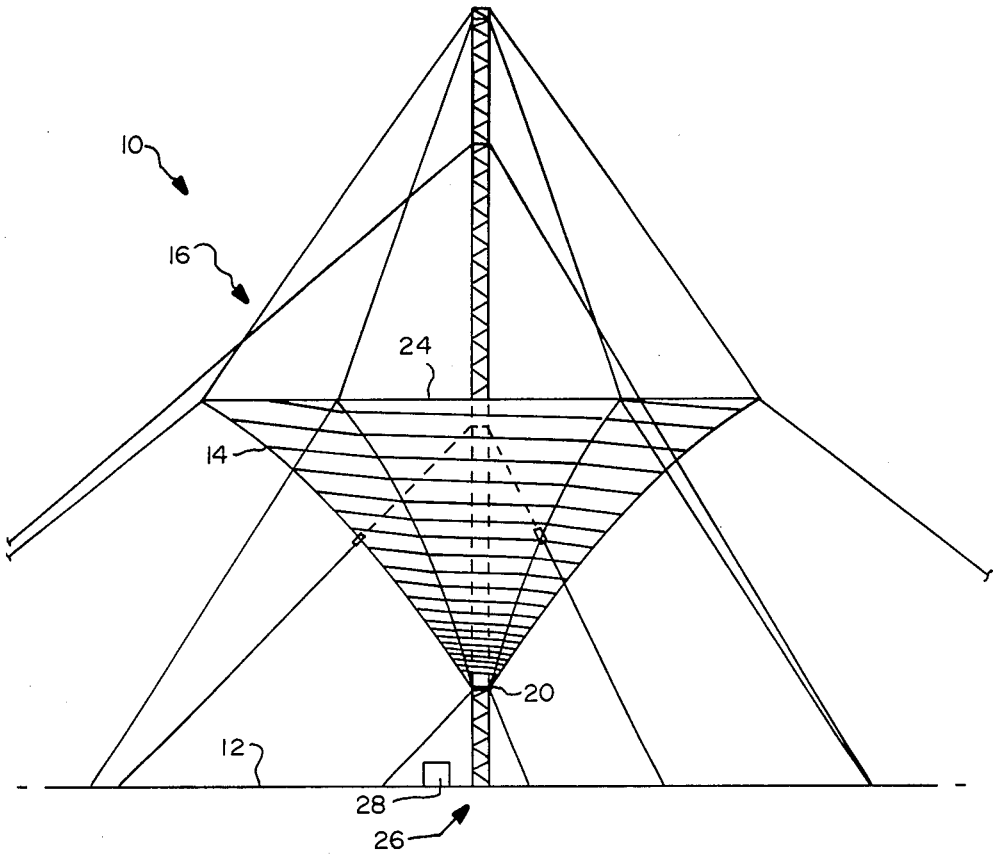
FIG. 1 is a front elevational view of the antenna described in the previously recited Werner et al patent application.
Figure 2:
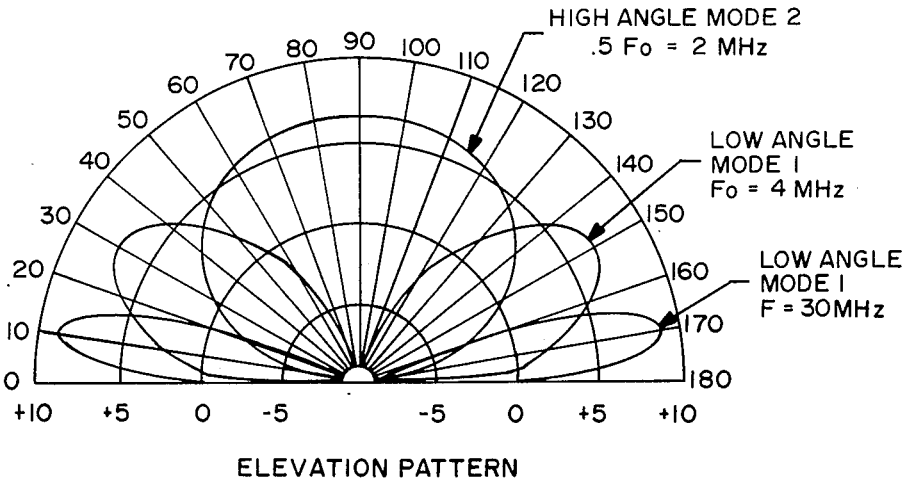
FIG. 2 shows elevation radiation patterns for the high and low angle operating modes of the Werner et al antenna illustrated in FIG. 1.
Figure 3:
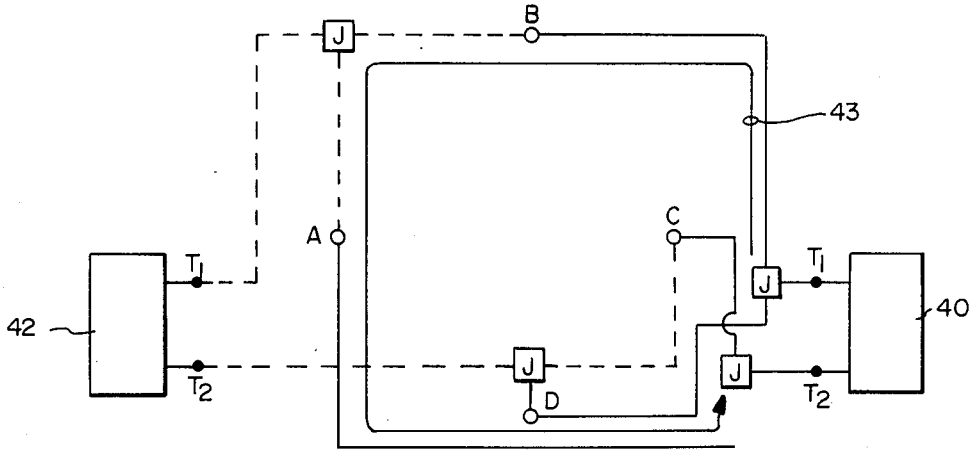
Figure 4:
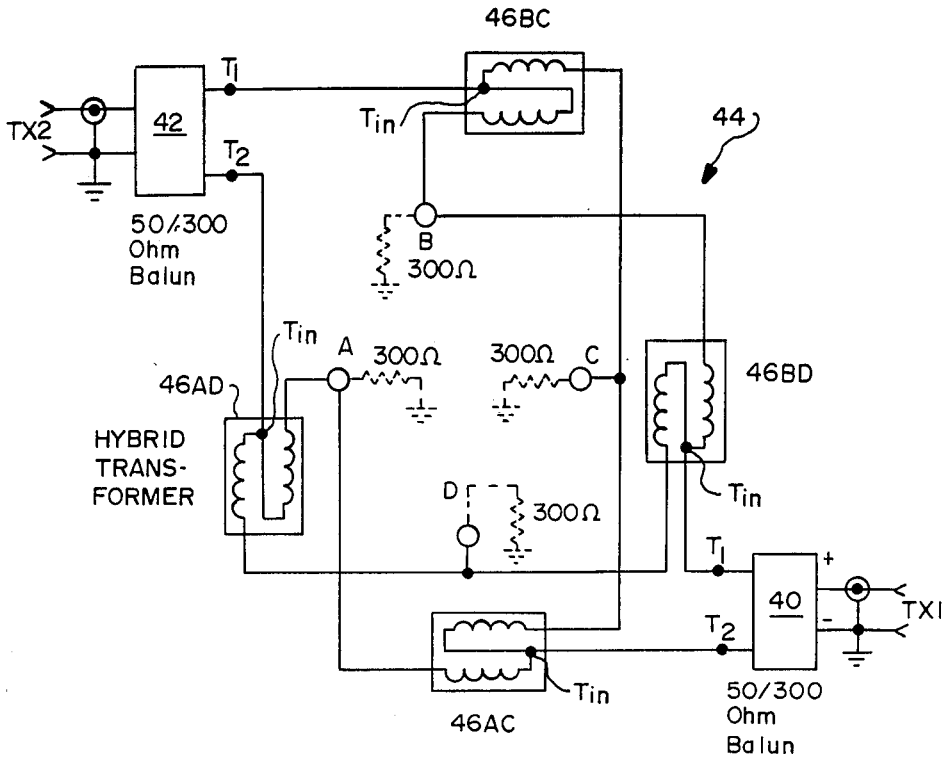
Figure 6:
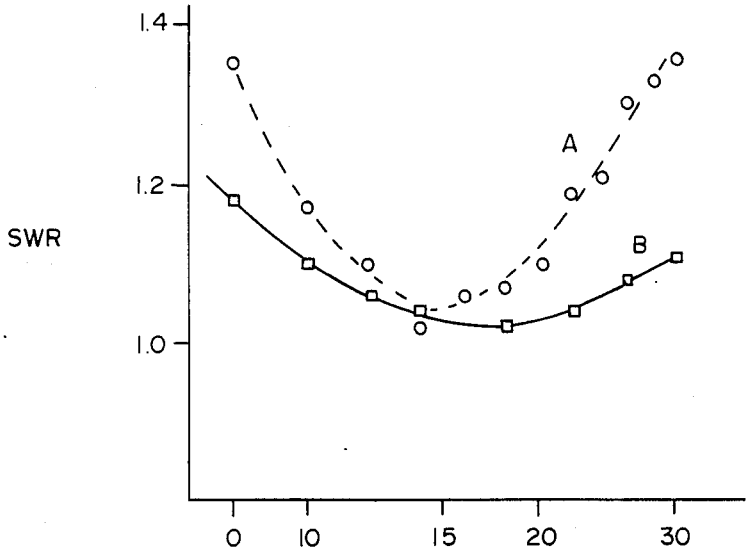
Figure 5A:
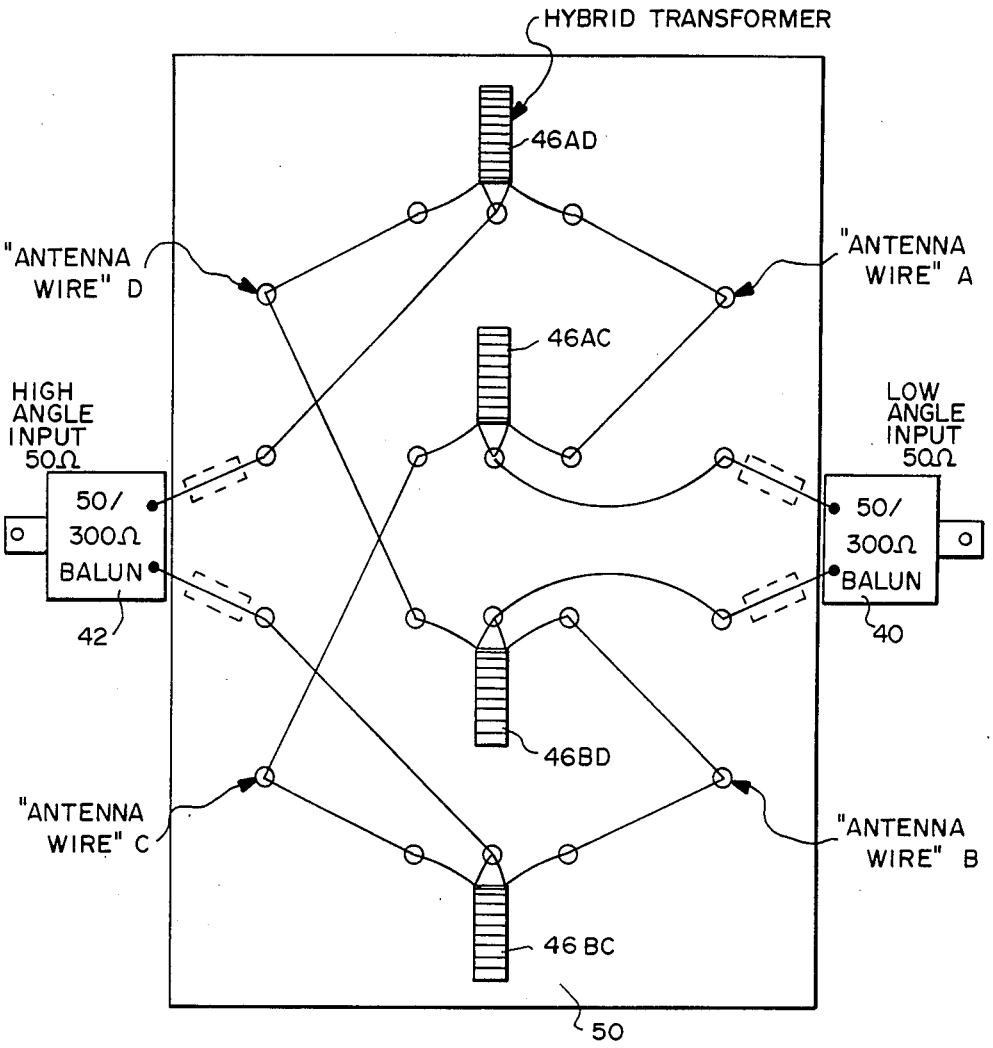
Figure 5B:
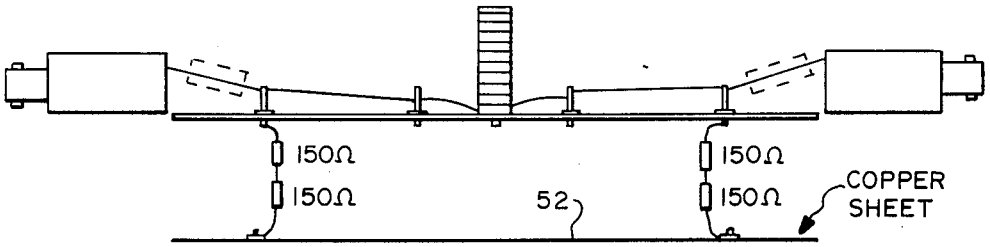
Figure 7A:
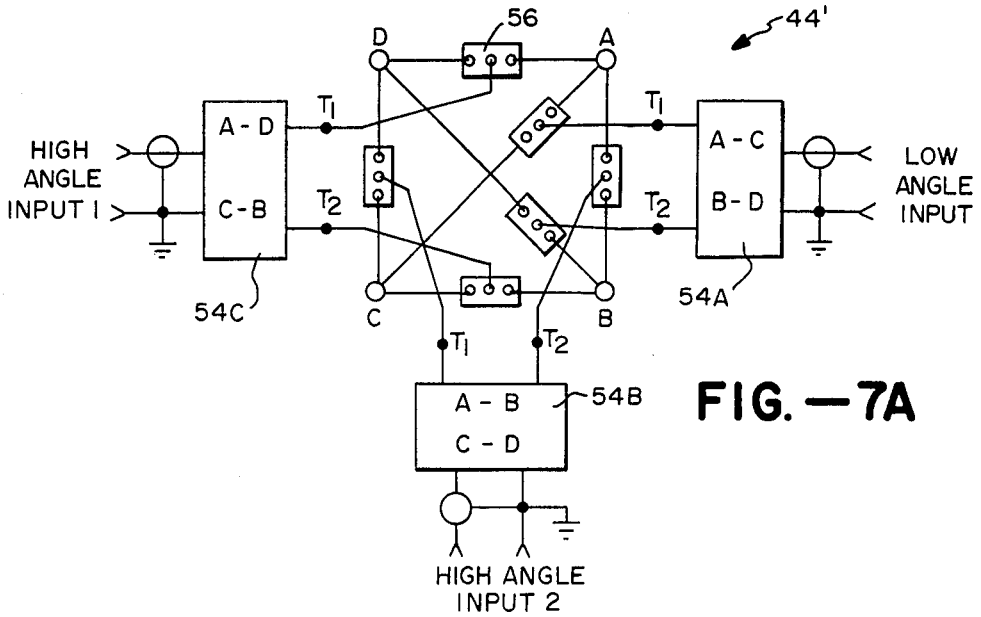
Figure 7B:
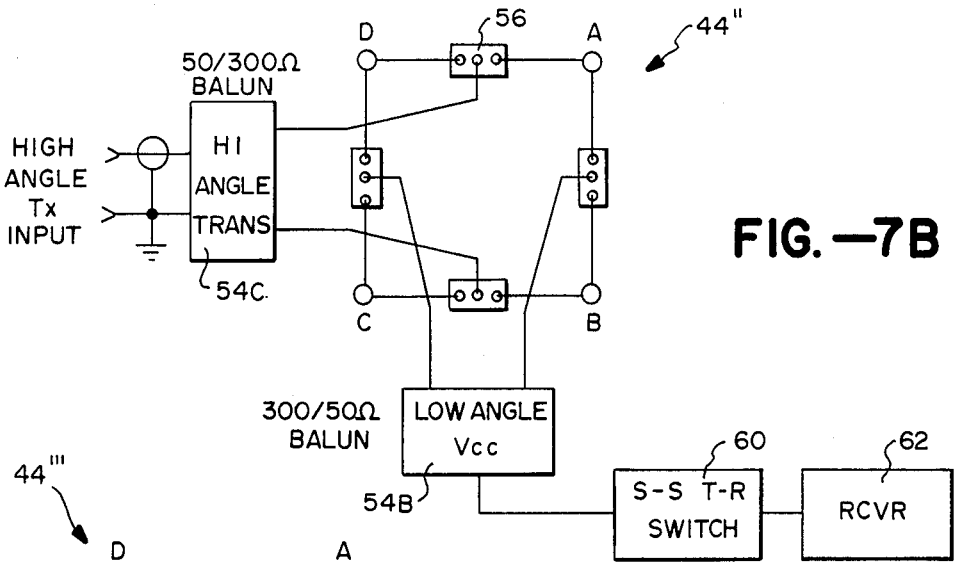

FIG. 3 diagrammatically illustrates why the antenna disclosed in the Werner et al patent application cannot, without aid of the present invention, simultaneously produce the two radiation patterns illustrated in FIG. 2;

FIG. 4 diagrammatically illustrates an arrangement designed in accordance with the present invention for energizing the radiators of an antenna of the general type illustrated in FIG. 1 in order to produce simultaneously the low and high angle radiation patterns illustrated in FIG. 2;

FIGS. 5A and 5B diagrammatically illustrate an actual test embodiment representing the antenna of the present invention based on the diagrammatic illustration in FIG. 4;

FIG. 6 graphically illustrates the standing wave ratio of impedance looking to the 50 ohm input forming part of the actual test embodiment of FIG. 5; and FIGS. 7A and 7B diagrammatically illustrate modified arrangements for energizing the radiators forming an antenna of the general type illustrated in FIG. 1.

Figure 8:
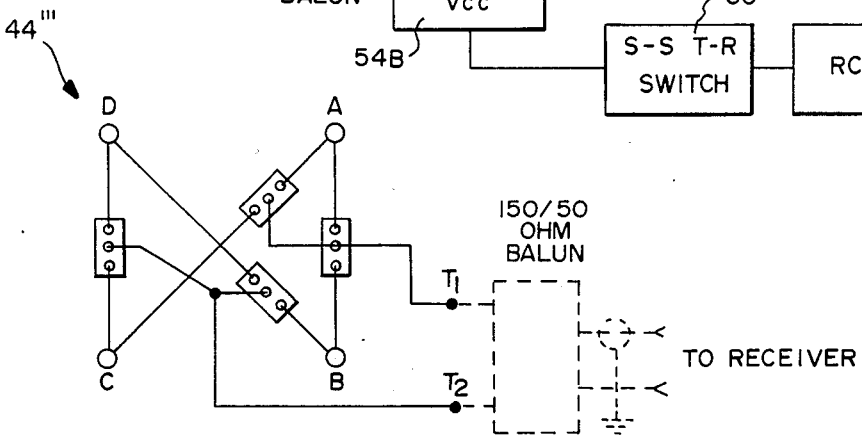
Figure 9:
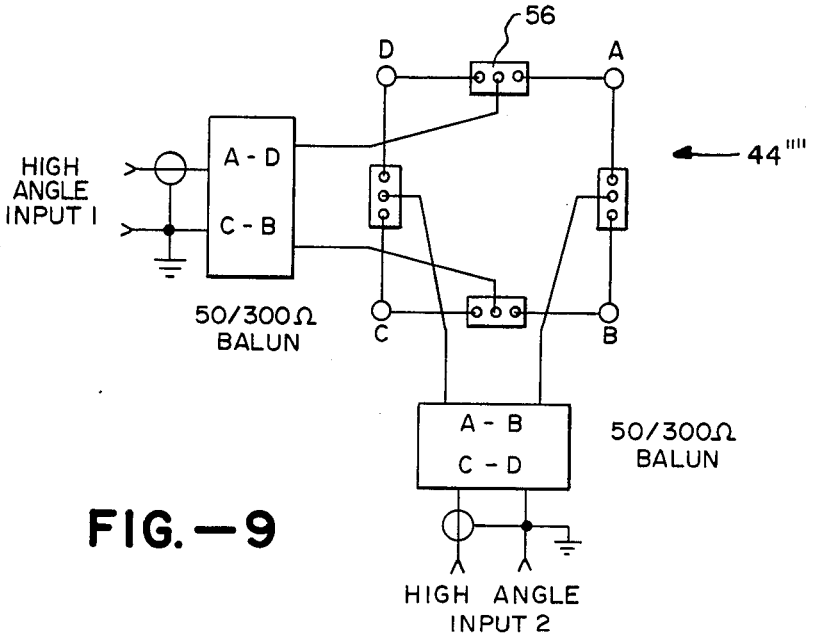
Figure 10:
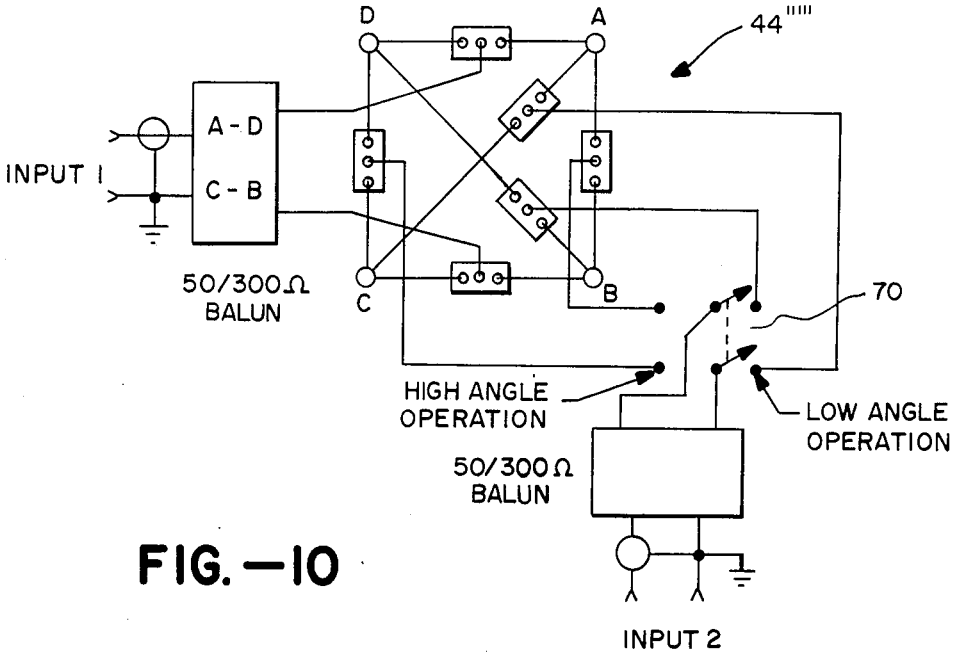

FIGS. 8, 9 and 10 diagammatically illustrate further modified embodiments of the present invention.

Turning now to the drawings, wherein like components are designated by like reference numerals throughout the various figures, attention is first directed to FIG. 1 which illustrates an antenna 10 located on a horizontally extending ground plane 12 which may actually be ground level or it could be a raised support surface such as the roof of a building. This antenna, which corresponds to the one specifically disclosed in the previously recited Werner et al patent application, may be divided into two sections. These sections include a radiating section 14 which, as will be seen hereinafter, is in the form of a four element (radiator) inverted conical log-spiral and a support section 16 for maintaining the central axis of the spiral cone in a vertically extending direction and its apex a predetermined distance above the ground plane.

As described in more detail in the Werner et al patent application, antenna 10 is designed to operate in two alternate modes, one providing a low angle, omni-directional radiation pattern and the other providing a high angle, omni-directional radiation pattern. The low angle pattern is best illustrated by the low angle lobes in the elevation pattern shown in FIG. 2 and the high angle pattern is best illsutrated by the high angle lobe shown there. It should be especially apparent from FIG. 2 that antenna 10 is capable of radiating at elevation angles from zenith to its lowest lobe within a relatively broad bandwidth of 2 MHz (its low frequency cut-off) to 30 MHz (its high frequency cut-off). While the antenna produces nulls in its pattern in one mode, the nulls become peaks in the other mode, thereby providing complete coverage.

Figure 1A:
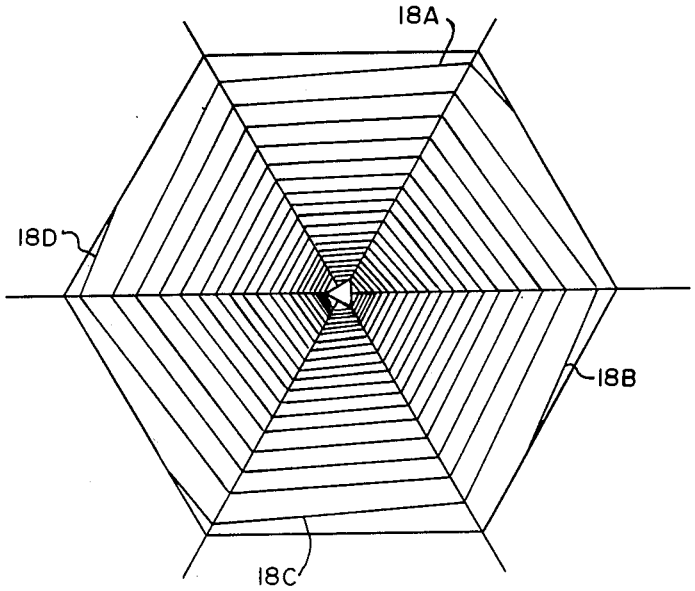
FIG. 1A is a top plan view of the antenna of FIG. 1.

Referring to FIG. 1A in conjunction with FIG. 1, the radiating section 14 of antenna 10 is shown including four wire radiators 18A, 18B, 18C and 18D (hereinafter merely referred to as raditors A, B, C and D). These radiators are supported by arrangement 16 in electrically insulated relationship to one another above horizontal ground plane 12 and around the surface of an imaginary inverted cone (specifically the hexagonal cone shown) having its apex 20 located a fixed distance above the ground plane and its central axis 22 extending vertically upward therefrom. The radiators A, B, C and D specifically define successively interlaced spiral windings beginning at the lowermost ends of the radiators adjacent apex 20 and ending at their uppermost ends adjacent the inverted base 24 of the cone. As described in the Werner et al application, the lowermost ends of the radiators are circumfrentially spaced 90° from each other about central axis 22. As best seen in FIG. 1A, their uppermost ends are also circumferentially spaced 90° from each other about the central axis. In actuality, the four radiators are identical or substantially identical in spiral configuration and are placed on the outer surface of the cone but rotated 90° relative to one another. In a preferred embodiment, the radiators 18 define a logarithmic spiral, although an Archimedes spiral could be utilized.

Antenna 10 also includes a power feed arrangement which is generally indicated at 26 in FIG. 1. This feed arrangement includes a power station 28 located for example on ground plane 12 adjacent the apex 20 of radiating cone 14. The power station includes suitable means for providing first and second alternating currents having the same amplitude and a given frequency within the bandwidth recited above, but 180° out of phase with one another. As described in the Werner et al patent application, the feed arrangement also includes a switch, for example a vacuum type of double pole double throw relay switch, which connects the lowermost ends of the wire radiators to the two AC currents in alternating high angle and low angle modes for selectively producing the previously described high angle and low angle radiation patterns. More specifically, when the switch is in its high angle position, it connects the lowermost ends of one directly adjacent pair of radiators, for example radiators A and B, to one of the AC currents and it connects the lowermost ends of the other pair of directly adjacent radiators, for example radiators C and D, to the other AC current. This functionally results in a two radiator spiral antenna (using all four radiators). When the switch is in it slow angle position, it connects one of the AC currents to the lowermost ends of one pair of opposing radiators, for example radiators A and C, while, at the same time, the other AC current is connected to the lowermost ends of the other pair of opposing radiators, for example radiators B and D. This functionally results in the previously described four radiator antenna.

Overall antenna 10 has only been described above, as it relates to the present invention For a more detailed description of this antenna, reference is made to previously recited Werner et al patent application which is incorporated herein by reference. As described in this application and as stated previously, the Werner et al antenna is designed to produce alternatively the high and low angle radiation patterns illustrated in FIG. 2. The antenna, as described, is not capable of providing both patterns simultaneously. This is best exemplified in FIG. 3 which diagrammatically illustrates the four radiators A, B, C and D in combination with two current sources generally indicated at 40 and 42. Each current source has two terminals, $T_1$ and $T_2$, which provide the previously recited first and second alternating currents having the same amplitude and a given frequency, but 180° out of phase with one another. For purposes of simplicity, one of these AC current will be referred to as a positive current and the other will be referred to as a negative current.

The current source 40 is shown connected to the radiators A, B, C and D in the low angle operating mode of antenna 10. Specifically, one of the AC current, for example the positive one, is connected to radiators B and D from terminal $T_1$ through connected junction J while the other AC current, for example the negative one, is connected to the radiators A and C from terminal $T_2$ through another junction J. The current source 42 is shown connected with the radiators in the high angle operating mode of antenna 10. Specifically, the positive AC current is connected to radiators A and B from terminal $T_1$ through a junction J and the negative AC current is connected to the terminals C and D from junction $T_2$ through a junction J. With the radiators connected up simultaneously to current sources 40 and 42 in this way, it should be apparent from FIG. 3 that the terminals $T_1$ and $T_2$ of each current source would be short circuited. For example, assuming the connections are as shown in FIG. 3, it is possible to get from terminal $T_1$ of source 40 to terminal $T_2$ of the same source without going through a load, as indicated by the arrow 43. This is also true for the terminals $T_1$ and $T_2$ of source 42, although for purposes of clarity no arrow has been shown between these latter terminals. In each case, the connection between the antenna radiators and each current source is responsible for shorting out the terminals of the other current source. Thus, it is not possible to operate antenna 10 in both of its operating modes without eliminating this problem. As will be seen below, the present invention does eliminate the problem by providing a specific radiator energizing arrangement which isolates the two modes in a way which allows them to operate simultaneously.

Referring to FIG. 4, the same four radiators A, B, C and D illustrated in FIGS. 1, 1A and 3 are shown. In an actual working embodiment, each has an effective impedance R to ground of, for example, a nominal value of 300 ohms, as indicated symbolically. These radiators which are fixedly supported relative to one another and to ground plane 12 in the manner recited are shown in combination with an overall radiator energizing arrangement generally indicated at 44. Arrangement 44 is comprised of the two current sources 40 and 42 discussed above with regard to FIG. 3 and four hybrid transformers 46AD, 46BC, 46BD and 46AC which are interconnected with the current sources and the radiators in the manner to be described below.

In the particular embodiment illustrated in FIG. 4, each current source is a 50/300 ohm balun transformer having a nominal input impedance presented to its balanced terminals $T_1$ and $T_2$ of 300 ohms, with an approximate SWr of 1.5:1. The use of this particular source assumes that the four radiators are symmetrical and that each presents an impedance to ground of 300 ohms, as stated above. Each of the hybrid transformers includes a pair of magnetic coils which are interconnected in a magnetically subtractive fashion relative to its input terminal $T_{in}$. Thus, with respect to AC currents passing through the coils from terminal $T_{in}$, the resultant magnetic fields cancel one another which, in turn, means that the overall hybrid transformer acts merely as a low or zero impedance junction. On the other hand, with respect to AC current passing through the coils in the opposite direction, the coils are additive and the overall hybrid transformer presents sufficiently high reactance to function as an effective open circuit. It is to be understood that both these hybrid transformers and the current sources just described are readily providable by those with ordinary skill in the art to which the present invention pertains.

As specifically illustrated in FIG. 4, the terminal $T_1$ of source 40 is connected to the radiators B and D through the hybrid transformer 46BD from its input terminal $T_{in}$. Terminal $T_2$ of this same current source is connected to the radiators A and C through transformer 46AC from its terminal $T_{in}$. Since the AC currents energizing the antennas from source 40 enter transformers 46BD and 46AC from their input terminals $T_{in}$, the transformers act merely as jucntions, e.g. as if they were not there. In this way, the source 40 can energize the four radiators in the manner required to produce the low angle radiation pattern illustrated in FIG. 2. As will be discussed hereinafter, the fact that current source 42 is also connected to the radiators in the manner to be described below does not prevent source 40 from opeating in this manner.

As also seen in FIG. 4, terminal $T_1$ of current source 42 is connected to the radiators B and C through the hybrid transformer 46BC through its input terminal $T_{in}$. At the same time, terminal $T_2$ of transformer 42 is connected to radiators A and D through transformer 46 AD from its input terminal $T_{in}$. Since the AC currents from source 42 enter these transformers from their input terminals, the transformers merely function as junctions and therefore source 42 energizes the radiators in the manner necessary to produce the high angle radiation pattern shown in FIG. 2. As will be seen below, the fact that source 40 is also connected to the radiators does not prevent source 42 from operating in this manner.

Still referring to FIG. 4, the reason that the operation of current source 40 on radiators A, B, C and D is not affected by the simultaneous operation of current source 42 on the radiators, and vice versa, is because of hybrid transformers 46. For example, current from terminal $T_1$ of source 42 passing through transformer 46BC to radiators B and C is effectively blocked from reaching source 40 of its own $T_2$ terminal by the transformers 46BD and 46AC which function as open circuits to this current. At the same time, current from terminal $T_2$ of current source 42 directed to radiators A and D are blocked from reaching current source 40 or its own terminal $T_1$ by the same transformers which, again, act as open circuits to this current. Thus, current source 42 functions to energize radiators A, B, C and D as if source 40 were not connected to the radiators. In the same manner, AC current from terminal $T_1$ of transformer 40 directed to radiators B and D are blocked from reaching current source 42 or its own terminal $T_2$ by hybrid transformers 46BC and 46AD which function as open circuits to this current. At the same time, current from terminal $T_2$ of source 40 which is directed to radiators A and C is blocked from reaching source 42 or its own terminal $T_1$ by the same transformers which, again, function as open circuits to this current. Thus, current source 40 serves to energize radiators A, B, C and D as if source 42 were not connected to the radiators. As a result, the radiators receive current from each source simultaneously, as if the other was not there, and therefore these radiators simultaneously produce the high and low angle radiation patterns shown in FIG. 2.

In view of the foregoing, it should be apparent that radiator energizing arrangement 44 in combination with the four radiators A, B, C and D forming part of antenna 10 provide a way of simultaneously producing the high and low angle radiation patterns shown in FIG. 2. However, it should be apparent that arrangement 44 is not limited to the particular configuration of radiators illustrated but may be equally applicable with regard to other types of radiator combinations. It should also be apparent that the present invention is not limited to the particular current sources and hybrid transformers shown so long as suitable devices are provided to eenrgize the cooperating radiators in a manner which allows simultaneous production of different radiation patterns. Also, it is quite possible to use a single current source rather than dual sources, as will be discussed hereinafter with regard to FIG. 8. Finally, with regard to the breadth of the present invention, it should also be apparent that hybrid transformers 46 (or equivalent devices) could be used in conjunction with the radiators to serve as a dual mode receiving antenna, that is, as a means of simultaneously receiving two radiation patterns. This is best exemplified in FIG. 8 also, as will be discussed.

Having described overall radiator energizing arrangement 44 in conjunction with the rest of antenna 10 illustrated in FIGS. 1 and 1A, attention is now directed to FIGS. 5A and 5B which illustrate an actaul test embodiment of arrangement 44 including the two 50/300 ohm balun transformers 40 and 42 and the four hybrid transformers 46. These latter transformers are assembled on a sheet 50 of electrical insulating material. Rather than using actual radiators, which would have been impractical for purposes of evaluation, 300 ohm resistors were used in their place. These resistors were connected from terminals on the sheet 50, which terminals respresented the antenna radiators, to a copper ground plane 52 (see FIG. 5B) about 1.5 inches below the insulation sheet. The radiator terminals were connected to the balun transformers and the hybrid transformers in the same manner shown in FIG. 4. Preliminary measurements of impedance looking into the "low angle" 50 ohm port showed an input SWR versus frequency as in FIG. 6, curve A. An improved result was obtained with compensating networks, as illustrated by curve B. While not shown, these compensating networks comprised inductances and capacitors. With or without these compensating networks, no change in the input impedance to one mode could be observed when the input to the other mode was opened, short circuited or connected to 50 ohms.

Referring now to FIG. 7A, a modified radiator energizing arrangement 44' is illustrated in conjunction with the same radiators A, B, C and D. In this arrangement, three current sources 54 which may be identical to current sources 40 and 42 are used along with six hybrid transformers 56 (as represented by rectangles) which may be identical to the transformers 46. In FIG. 7A, the input terminal $T_{in}$ of each hybrid transformer is diagrammatically represented by the center terminal in the rectangle and the outputs are represented by the two outer terminals. With this in mind, it should be apparent that the current source 54A energizes the radiators in the same manner as current souce 40 in order to provide the low angle radiation pattern and that the current source 54C energizes the radiators in the same manner as current source 42 in order to produce a corresponding high angle radiation pattern. In addition, current source 54B energizes the radiators A and B from its terminal $T_2$ and C and D from its terminal $T_1$ in order to provide a second type of high angle radiation pattern. In other words, the overall arrangement 44' differs from arrangement 44 in that it provides three radiations patterns simultaneously. Each current source 54 is isolated from the others by means of the hybrid transformers in the manner described previously.

FIG. 7B illustrates a radiator arrangement 44" which includes high angle transmission through source 54C, without current sources 54a or 54B. In other words, arrangement 44" energizes the four radiators A, B, C and D in one high angle mode. However, a low power, high speed transmit/receive switch 60 and a receiver 62 are coupled to a balun transformer 54B to the four radiators in the manner shown through isolation transformer 56 in order to operate the overall arrangement as a transmit/receive station. While it is not possible to simultaneously transmit and receive with overall arrangement 44", because of the isolation between the transmit and receive modes, the switch 60 can be a low power switch and the receiver 62 does not need to be electronically insulated to any significant degree from the high voltage which develops across transformer 54C during the transmission mode.

Referring to FIG. 8, a radiator arrangement 44''' is shown including the same radiators A, B, C and D and isolation transformers 46 forming part of arrangement 44.

However, all of the radiators and the isolation transformers of arrangement 46''' are ultimately connected to a single pair of terminals $T_1$, $T_2$ so that a single current source (not shown) can be used to energize the radiators to provide simultaneous high and low angle modes of operation rather than two such sources (40 and 42) as in arrangement 44. Also, by connecting a suitable transformer to the two terminals rather than a current source such as the one shown by dotted lines in FIG. 8, arrangement 44''' could be used to receive high and low angle radiation patterns simultaneously.

FIG. 9 shows an arrangement 44'''' which functions in the same manner as arrangement 44', without the low angle mode and thus uses only four isolation transformers 56. FIG. 10 shows an arrangement 44''''' which also functions in the same manner as arrangement 44', except that a double pole double throw switch 70 is used to alternate between the low angle mode and one of the high angle modes using a single current source.

What is claimed is:

1. An antenna, comprising: a plurality of radiators; means for supporting said radiators in electrically insulated relationship to one another relative to a fixed reference; first means connectable with all of said radiators in a first specific operating mode for energizing all of the radiators at a first particular frequency in order to cause them to produce a first specific radiation pattern at said first frequency relative to said fixed reference; second means connectable with all of said radiators in a second specific operating mode different from said first mode for energizing all of the radiators at a second different frequency in order to cause them to produce a second different specific radiation pattern at said second frequency relative to said fixed reference; and means for simultaneously connecting said first and second radiator energizing means with all of said radiators in their respective first and second operating mode without any appreciable electrical interference with one another in order to cause said radiators to simultaneously produce each of said first and second radiation patterns at said first and second frequencies, respectively, as if the other were not present; said radiators including first, second, third and fourth radiators; said radiator support means supporting said four radiators around the outer surface of an imaginary cone; said first, second, third and fourth radiators being supported so as to define successively interlaced first, second third and fourth conical spiral windings; each of said first and second radiator energizing means including means for providing first and second alternating currents having the same amplitude and a given frequency but 180° out of phase with one another; said connecting means including first current connecting means simultaneously electrically connecting said first current to the lowermost ends of said first and second radiators and said second current to the lowermost ends of said third and fourth radiators for energizing said radiators in said first operating mode in order to cause them to produce said first radiation pattern relative to said reference plane; said connecting means also including second current connecting means simultaneously connecting said first current to the lowermost ends of said first and third radiators and said second current to the lowermost ends of said second and fourth radiators for energizing said radiators in said second operating mode in order to cause them to produce said second radiation pattern relative to said reference; each of said first and second radiator energizing means including its own one of said alternating current providing means; said first current connecting means including first isolating means for preventing the connections of said radiators in said second operating mode by said second current connecting means from affecting the energization of the radiators in said first operating mode; said second current connecting means including second isolating means for preventing the connections of said radiators in said first operating mode by said first current connecting means from affecting the energization of the radiators in said second operating mode; said first isolating means including first impedance means located electrically between said current providing means on one side and said first and second radiators on the other side and functioning as an effective short circuit to the current energizing the radiators in said first operating mode while functioning as an effective open circuit to the current energizing these same radiators in said second operating mode; said first isolating means including second impedance means located electrically between said current providing means on one side and said third and fourth radiators on the other side and functioning as an effective short circuit to the current energizing these radiators in said first operating mode while functioning as an effective open circuit to the current energizing these same radiators in said second operating mode; said second isolating means including its own first impedance means located electrically between said current providing means on one side and said first and third radiators on the other side and functioning as an effective short circuit to the current energizing these radiators in said second operating mode while functioning as an effective open circuit to the current energizing these same radiators in said first operating mode; and said second isolating means including its own second impedance means located electrically between said current providing means on one side and said second and fourth radiators on the other side and functioning as an effective short circuit to the current energizing these radiators in said second opeating mode while functioning as an effective open circuit to the current energizing these same radiators in said first operating mode.

2. An antenna according to claim 1 wherein said fixed reference is a fixed ground plane and said first and second radiation patterns are high and low radiation patterns, respectively, relative to said ground plane.

3. An antenna, comprising: a plurality of radiators; means for supporting said radiators in electrically insulated relationship to one another relative to a fixed reference; first means connectable with said radiators in a first specific operating mode for energizing the radiators in order to cause them to produce a first specific radiation pattern relative to said fixed reference; second means connectable with said radiators in a second specific operating mode different from said first mode for energizing the radiators in order to cause them to produce a second specific radiation pattern relative to said fixed reference and different than said first pattern and means for simultaneously connecting said first and second radiator energizing means with said radiators in their respective first and second operating mode without any appreciable electrical interference with one another in order to cause said radiators to simultaneously produce each of said first and second radiation patterns as if the other were not present, said radiators including first, second, third and fourth radiators and said radiator support means supporting said four radiators around the outer surface of an imaginary inverted cone having its apex located a fixed distance above said plane and its central axis extending vertically upward therefrom, said first, second, third, and fourth radiators being supported so as to define successively interlaced first, second, third and fourth conical spiral windings, respectively, beginning at the lowermost ends of the radiators adjacent the apex of said cone, said lowermost ends being circumferentially spaced 90° from each other about said central axis.

4. An antenna according to claim 3 wherein each of said first and second radiator energizing means includes means for providing first and second alternating currents having the same amplitude and a given frequency but 180° out of phase with one another, and wherein said connecting means includes first current connecting means simultaneously electrically connecting said first current ot the lowermost ends of said first and second radiators and said second current to the lowermost ends of said third and fourth radiators for energizing said radiators in said first operating mode in order to cause them to produce said high angle radiation pattern relative to said horizontal ground plane, said connecting means also including second current connecting means simultaneously connecting said first current to the lowermost ends of said first and third radiators and said second current to the lowermost ends of said second and fourth radiators for energizing said radiators in said second operating mode in order to cause them to produce said low angle radiator pattern relative to said horizontal plane.

5. An antenna according to claim 4 wherein each of said first and second radiator energizing means includes its own one of said alternating current providing means.

6. An antenna according to claim 4 wherein said first current connecting means includes first isolating means for preventing the connections of said radiators in said second operating mode by said second current connecting means from affecting the energization of the radiators in said first operating mode and wherein said second current connecting means includes second isolating means for preventing the connections of said radiators in said first operating mode by said first current connecting means from affecting the energization of the radiators in said second operating mode.

7. An antenna according to claim 6 wherein:

(a) said first isolating means includes first impedance means located electrically between said current providing means on one side and said first and second radiators on the other side and functioning as an effective short circuit to the current energizing these radiators in said first opeating mode while functioning as an effective open circuit to the current energizing these same radiators in said second operating mode;

(b) siad first isolating means includes second impedance means located electrically between said current providing means on one side and said third and fourth radiators on the other side and functioning as an effective short circuit to the current energizing these radiators in said first operating mode while functioning as an effective open circuit to the current energizing these same radiators in said second operating mode;

(c) said second isolating means includes its own first impedance means located electrically between said current providing means on one side and said first and third radiators on the other side and functioning as an effective short circuit to the current energizing these radiators in said second operating mode while functioning as an effective open circuit to the current energizing these same radiators in said first operating mode; and (d) said second isolating means includes its own second impedance means located electrically between said current providing means on one side and said second and fourth radiators on the other side and functioning as an effective short circuit to the current energizing these radiators in said second operating mode while functioning as an effective open circuit to the current energizing these same radiators in said first operating mode.

8. An antenna according to claim 7 wherein each of said impedance means is a hybrid transformer.

9. An antenna according to claim 7 wherein each of said first and second radiator energizing means includes its own one of said alternating current providing means.

10. An antenna, comprising: a plurality of radiators; means for supporting said radiators in electrically insulated realtionship to one another relative to a fixed reference; and a radiator energizing arrangement including first means connected with all of said radiators in a first specific operating mode for energizing the radiators with AC current at a first particular frequency to produce a first specific radiation pattern relative to said fixed reference and second means connected with all of said radiators in a second, different specific operating mode for energizing the radiators with AC current at a second different particular frequency to produce a second, different specific radiation pattern relative to said fixed reference, said first radiator energizing means including its own first current isolting means consisting essentially of a plurality of impedance devices which function as both open and short circuits for preventing the connection of said second radiator energizing means with all of said radiators in said second operating mode from affecting the energization of said radiators in said first opeating mode and said second radiator energizing means including its own second current isolating means consisting essentially of said plurality of impedance devices for preventing the connection of said first radiator energizing means with all of said radiators in said first operating mode from affecting the energization of said radiators in said second operating mode, whereby all of the radiators can be energized in both of said operating modes simultaneously for producing said radiation patterns simultaneously; said first and second radiator energizing means respectively including first and second means for providing said AC currents, each of said first and second AC current providing means having first and second terminals providing first and second alternating currents with the same amplitude and said first and second frequencies, respectively, but 180° out of phase with one another, wherein said first current isolating means functions to prevent the connection of said second radiator energizing means with said radiators in said second operating mode from electrically shorting together the first and second terminals of said first AC current providing means and wherein said second current isolating means functions to prevent the connection of said first radiator energizing means with said radiators in said first opeating mode from electrically shorting together the first and second treminals of said second AC current providing means.

11. An antenna according to claim 10 wherein each of said isolating means includes at least one hybrid transformer.

12. An antenna according to claim 10 wherein said fixed reference is a ground plane and wherein said first and second specific radiation patterns are high and low radiation patterns, respectively, relative to said ground plane.

13. An antenna according to claim 10 wherein said fixed reference is a ground plane and wherein said first and second specific radiation patterns are different high radiation patterns, respectively, relative to said ground plane.

14. An antenna according to claim 10 wherein said first and second radiator energizing means include a common means for providing said AC currents for energizing said radiators in both of said operating modes, said common AC current providing means having first and second terminals providing first and second alternating currents with the same amplitude and a given frequency but 180° out of phase with one another, wherein said first current isolating means functions to prevent the connection of said common current providing means with said radiators in said second operating mode from electrically shorting together said first and second terminals and wherein said second current isolating means functions to prevent the connection of said common current providing means with said radiators in said first operating mode from electrically shorting together said first and second terminals.

15. An antenna according to claim 10 wherein said radiator energizing arrangement includes third means connected with all of said radiators in a third specific operating mode for energizing all of the radiators with AC current to produce a third specific radiation pattern relative to said fixed reference, said third radiator energizing means including its own third current isolating means for preventing the connection of said first and second radiator energizing means with said radiators in said first and second operating mode from affecting the energization of said radiators in said third operating mode, whereby the radiators can be energized in all three of said operating modes simultaneously for producing said radiation patterns simultaneously.

16. An antenna according to claim 10 wherein said radiator energizing arrangement includes third means connected with all of said radiators in a third specific operating mode for energizing the radiators with AC current to produce a third specific radiation pattern relative to said fixed reference, said third radiator energizing means including its own third current isolating means for preventing the connection of said first or second radiator energizing means with said radiators in said first or second operating mode from affecting the energization of said radiators in said third operating mode, said third energizing means including said second means for providing said AC current and means for alternatively connecting said second AC current providing means with said radiators to produce said second or third radiation patterns.

17. An antenna, comprising: first, second, third and fourth wire radiators; means for supporting said radiators in electrically insulated relationship to one another above a horizontal ground plane and around the outer surface of an imaginary inverted cone having its apex located a fixed distance above said plane and its central axis extending vertically upward therefrom, said first, second, third and fourth radiators being supported so as to define successively interlaced first, second, third and fourth conical spiral windings, respectively, beginning at the lowermost ends of the radiators adjacent the apex of said cone, said lowermost ends being circumferentially spaced 90° from each other about said central axis; first means for providing first and second alternating currents having the same amplitude and a given frequency but 180° out of phase with one another; first means for simultaneously electrically connecting said first current to the lowermost ends of said first and second radiators and said second current to the lowermost ends of said third and fourth radiators in order to cause said raditors to produce a high angle radiation pattern relative to said horizontal ground plane; second means for providing third and fourth alternating currents having the same amplitude and a given frequency but 180° out of phase with one another; and second means for simultaneously connecting said third current to the lowermost ends of said first and third radiators and said fourth current to the lowermost ends of said second and fourth radiators at the same time as said first current connecting means connects said first and second currents to said radiators whereby to cause said radiators to produce a low angle radiator pattern relative to said horizontal plane simultaneous with the production of said high angle pattern.

* * * * *